US006932748B2

(12) United States Patent
Huang

(10) Patent No.: US 6,932,748 B2
(45) Date of Patent: Aug. 23, 2005

(54) MULTIPURPOSE EXERCISER

(76) Inventor: Hsiao-Chung Huang, No. 512, Sec. 3, Jhongnan Rd., Tianjhong Township, Changhua County (TW)

( * ) Notice: Subject to any disclaimer, the term of this patent is extended or adjusted under 35 U.S.C. 154(b) by 67 days.

(21) Appl. No.: 10/691,567

(22) Filed: Oct. 24, 2003

(65) Prior Publication Data

US 2005/0101458 A1 May 12, 2005

(51) Int. Cl.[7] ..... A63B 21/00
(52) U.S. Cl. ..... 482/139; 482/102; 482/103
(58) Field of Search ..... 482/99, 101–103, 482/139, 140, 904, 907; 602/32, 33, 36

(56) References Cited

U.S. PATENT DOCUMENTS 5,842,961 A * 12/1998 Davis ..... 482/139
6,336,894 B1 * 1/2002 Kestila ..... 482/99
6,770,015 B2 * 8/2004 Simonson ..... 482/99

* cited by examiner

*Primary Examiner*—Glenn E. Richman
(74) *Attorney, Agent, or Firm*—Birch, Stewart, Kolasch & Birch, LLP

(57) ABSTRACT

Disclosed is a multipurpose exerciser comprising an upright frame, a top pulley on the frame, a steel rope to run the top pulley, a plurality of stacked blocks of weight fastened at one end of the steel rope, a lower pulley with the other end of the steel rope passed, a pair of first C-shaped tubes coupled to the other end of the steel rope, a pair of second C-shaped tubes, and a chain having both ends coupled to the second C-shaped tubes respectively and a midpoint fastened at the floor. Two or more of the legs and the arms are adapted to pass two or more of the tubes for achieving two or more of the purposes including contracting the abdominal muscles and training the arms, the legs, and the back muscles.

6 Claims, 8 Drawing Sheets

MULTIPURPOSE EXERCISER

FIELD OF THE INVENTION

The present invention relates to exerciser equipment and more particularly to a multipurpose exerciser adapted to achieve two or more of purposes including contracting the abdominal muscles and training the arms, the legs, and the back muscles.

BACKGROUND OF THE INVENTION

A conventional abdominal exerciser is shown in FIG. 1. The exerciser comprises an upright metal frame 1 provided on the floor, a pulley 2 on top of the frame 1, a steel rope 3 adapted to run the grooved rim of the pulley 2, a plurality of stacked blocks of weight 4 fastened at one end of the steel rope 3, a lower pulley 5 adjacent the blocks of weight 4, a pulling member 6 coupled to the other end of the steel rope 3 which passes the lower pulley 5, the pulling member 6 having left and right handles 7 adapted to be held by the hands, a pad 8 in the rear of the frame 1, the pad 8 being proximate the floor, and a pedal 9 in the intermediate portion of the frame 1. In use, a person lays his/her buttock on the pad 8 with two legs urged against the pedal 9, the left and right handles 7 held by two hands, and the back moved toward the rear of the frame 1 back and forth. As a result, the blocks of weight 4 are lifted as the other end of the steel rope 3 is pulled rearwardly by pulling the handles 7 to and fro. For lifting the blocks of weight 4 above their original position a predetermined height and maintaining the same for a period of time, the arms and the legs of the person has to exert much force. However, little force is exerted by the abdominal muscles. Hence, the prior abdominal exerciser fails to train the abdomen as it claims. Thus, the need for improvement still exists.

SUMMARY OF THE INVENTION

It is an object of the present invention to provide a simple, multipurpose exerciser adapted to achieve two or more of purposes including contracting the abdominal muscles and training the arms, the legs, and the back muscles. By utilizing the present invention, the purpose of losing weight can also be obtained in addition to body training.

The above and other objects, features and advantages of the present invention will become apparent from the following detailed description taken with the accompanying drawings.

DETAILED DESCRIPTION OF THE PREFERRED EMBODIMENT

Figure 1:
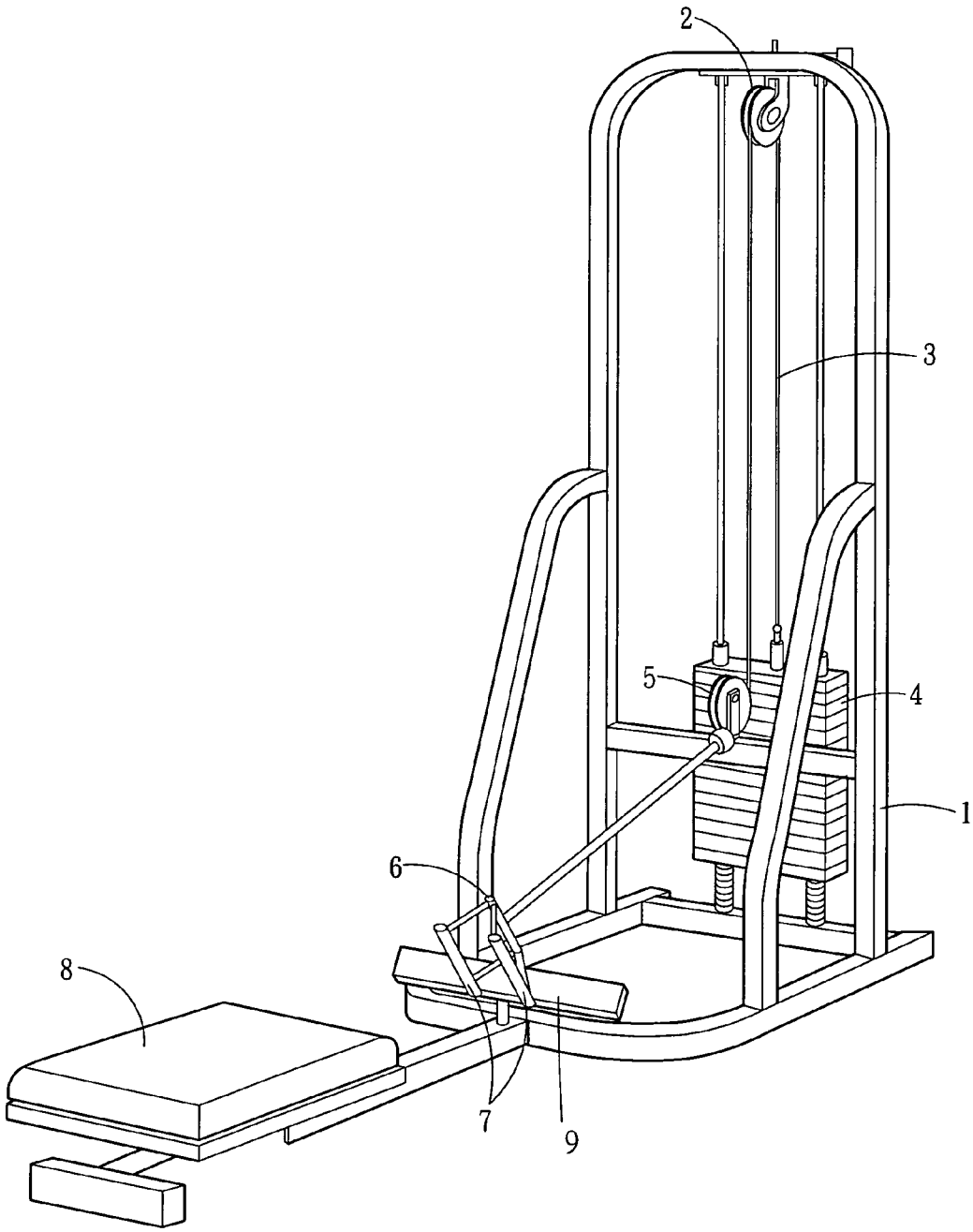
PRIOR ART F I G. 1
FIG. 1 is a perspective view of a conventional abdominal exerciser.
Figure 2A:
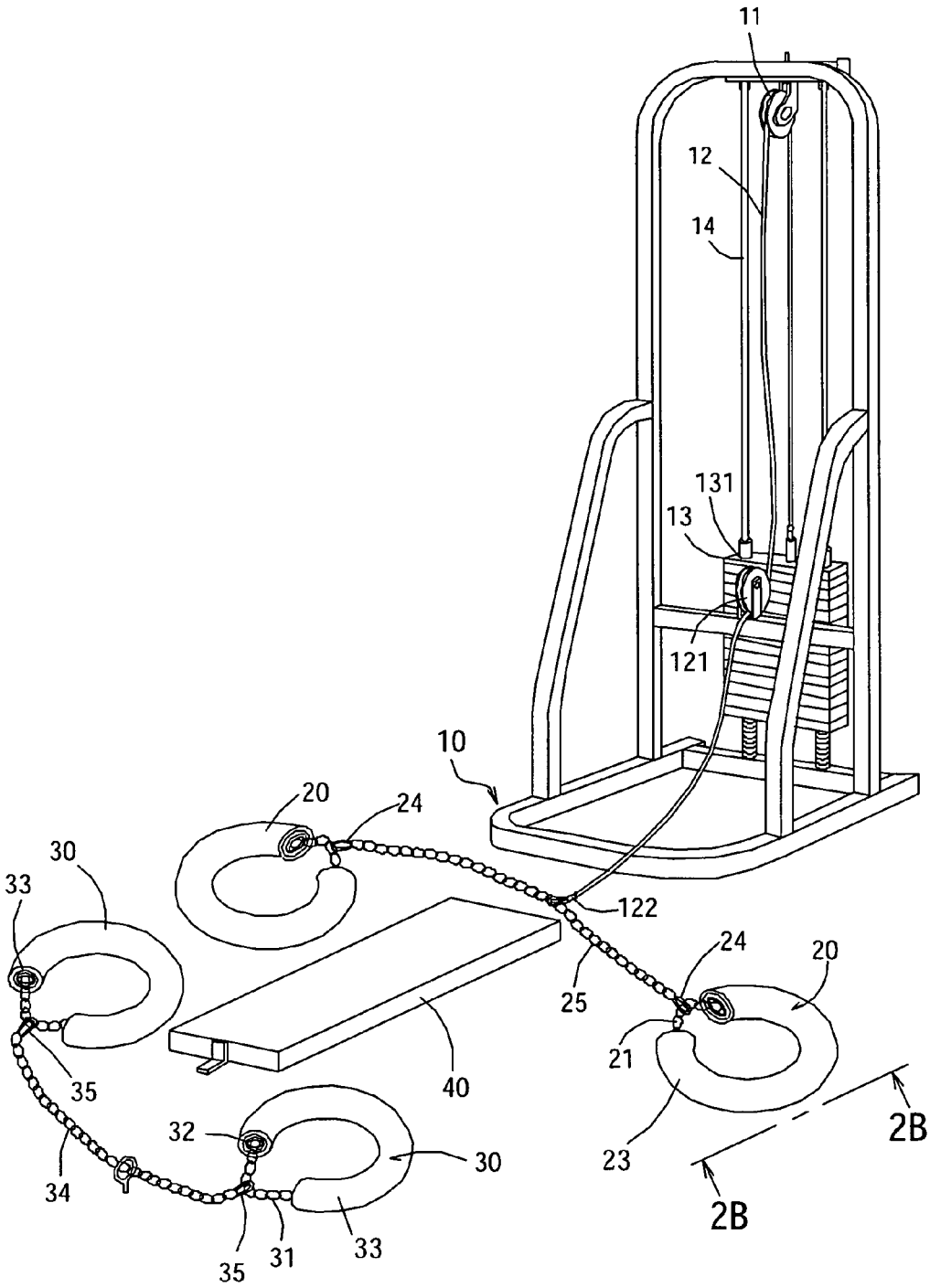
FIG. 2A is a perspective view of a preferred embodiment of multipurpose exerciser according to the invention.
Figure 2B:
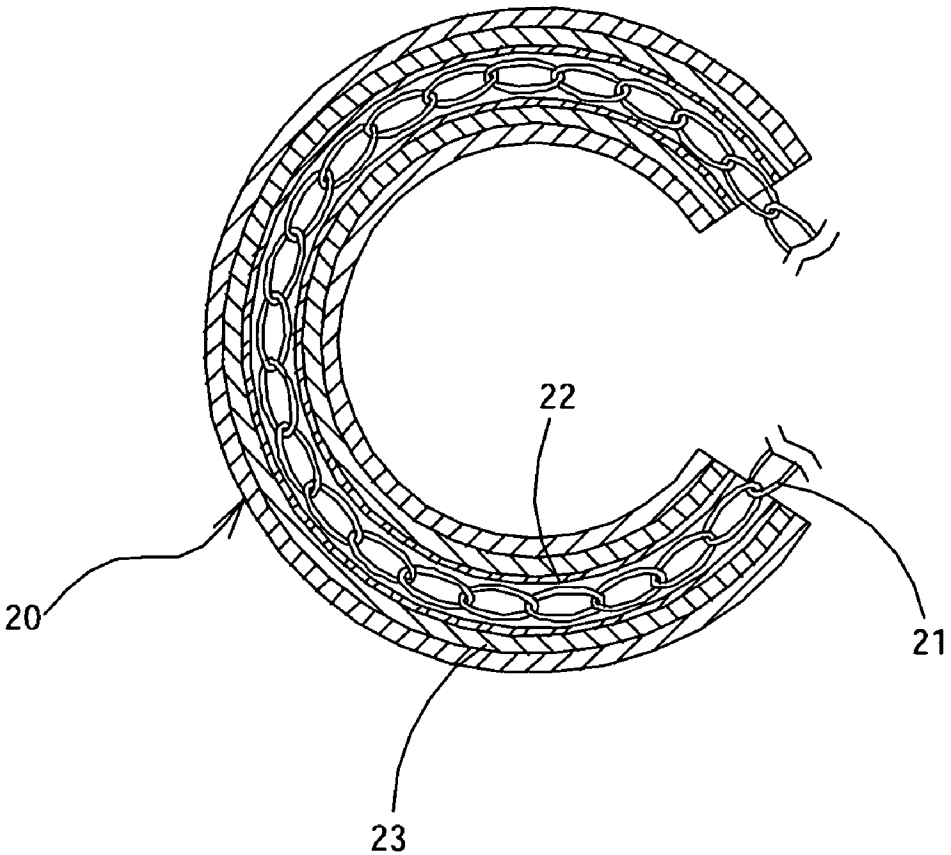
FIG. 2B is a sectional view of the first C-shaped tube taken along line 2B—2B of FIG. 2A.

Referring to FIGS. 2A and 2B, there is shown a multipurpose exerciser constructed in accordance with the invention comprising an upright metal frame 10 provided on the floor, a pulley 11 on top of the frame 10, a steel rope 12 adapted to run the grooved rim of the pulley 11, a plurality of stacked blocks of weight 13 in which the lowest block of weight 13 is fastened at one end of the steel rope 12, two posts 14 passed left and right channels 131 of the blocks of weight 13 to fasten between the top and the bottom of the frame 10, a lower pulley 121 adjacent the blocks of weight 13 with the other end of the steel rope 12 formed as a first ring 122 passed the grooved rim thereof, a pair of left and right first C-shaped tubes 20 in which each first C-shaped tube 20 comprises a plastic inner sleeve 22 with a circular first metal chain 21 passed, and two resilient outer sleeves 23 having a sufficient thickness fitted on the inner sleeve 22 (see FIG. 2B), two second rings 24 each coupled to the exposed portion of the first chain 21, a second chain 25 having both ends coupled to the second ring 24 and a midpoint coupled to the first ring 122, a pair of left and right second C-shaped tubes 30 each having a structure the same as that of the first C-shaped tube 20 in which each second C-shaped tube 30 comprises a plastic inner sleeve 32 with a circular third metal chain 31 passed, and two resilient outer sleeves 33 having a sufficient thickness fitted on the inner sleeve 32, two third rings 35 each coupled to the exposed portion of the first chain 31, and a fourth chain 34 having both ends coupled to the third ring 35 and a midpoint fastened at the floor.

Figure 3:
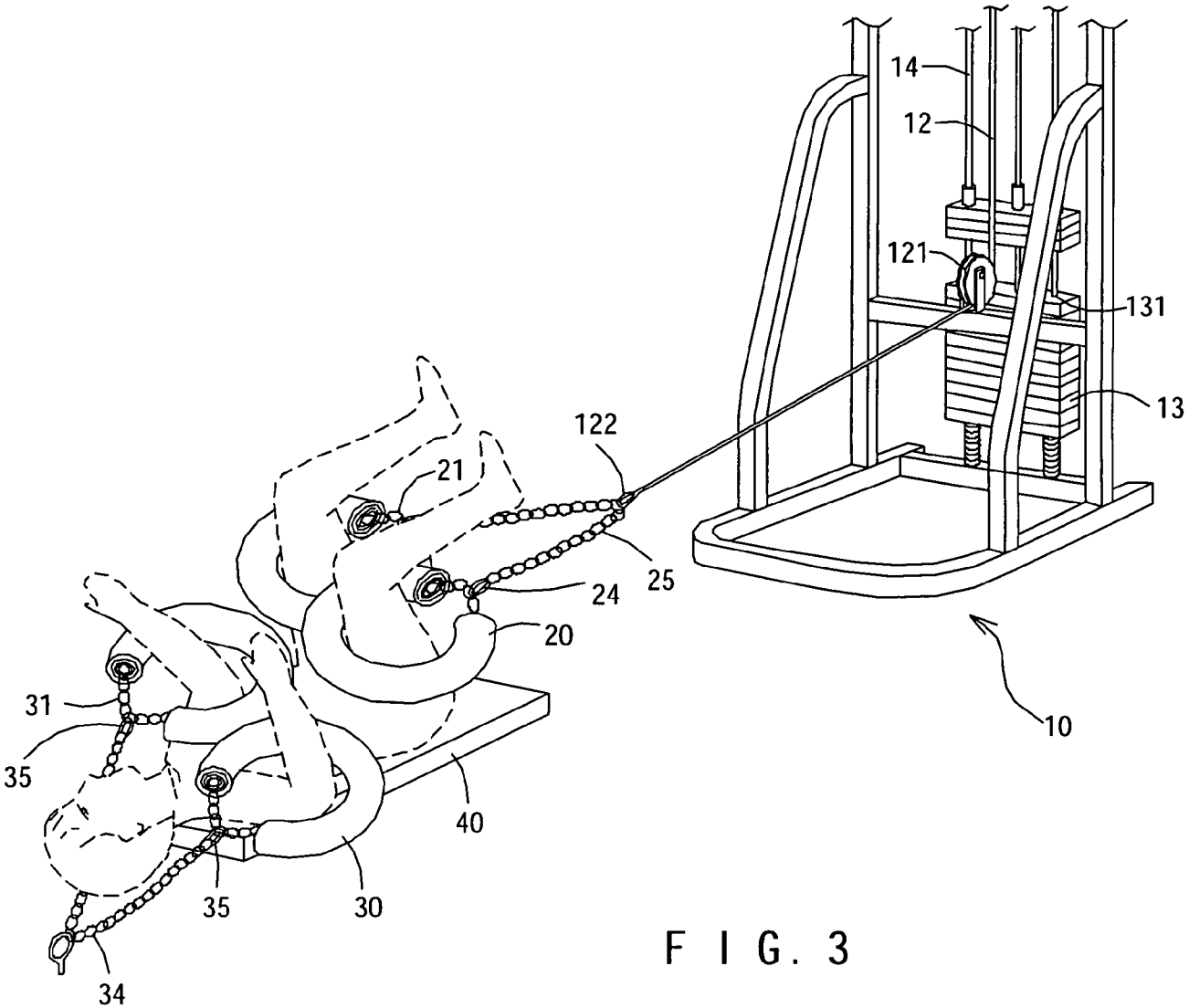
FIGS. 3 to 7 are perspective views depicting a plurality of methods of using the exerciser of the invention for training different parts of a user.

Referring to FIGS. 3 to 7, operations of the invention will now be described in detail below. As shown in FIG. 3 specifically, in one operation a person lays his/her back on a pad 40 on the floor between the left and right first C-shaped tubes 20 and between the left and right second C-shaped tubes 30 with two legs passed the first C-shaped tubes 20 and two arms passed the second C-shaped tubes 30 to cross in front of the chest. Next, the legs bend toward the abdomen. The abdomen then exerts force to cause the left and right first C-shaped tubes 20 to pull the steel rope 12 rearwardly, resulting in a lifting of a number of blocks of weight 13 along the posts 14 and maintaining the same for a period of time. Note that the number of blocks of weight 13 secured to the posts 14 can be increased or decreased depending on the physical strength of the user and desired extent of exercise. The to and fro operation thus illustrated aims at training both the arms and the legs.

Figure 4:
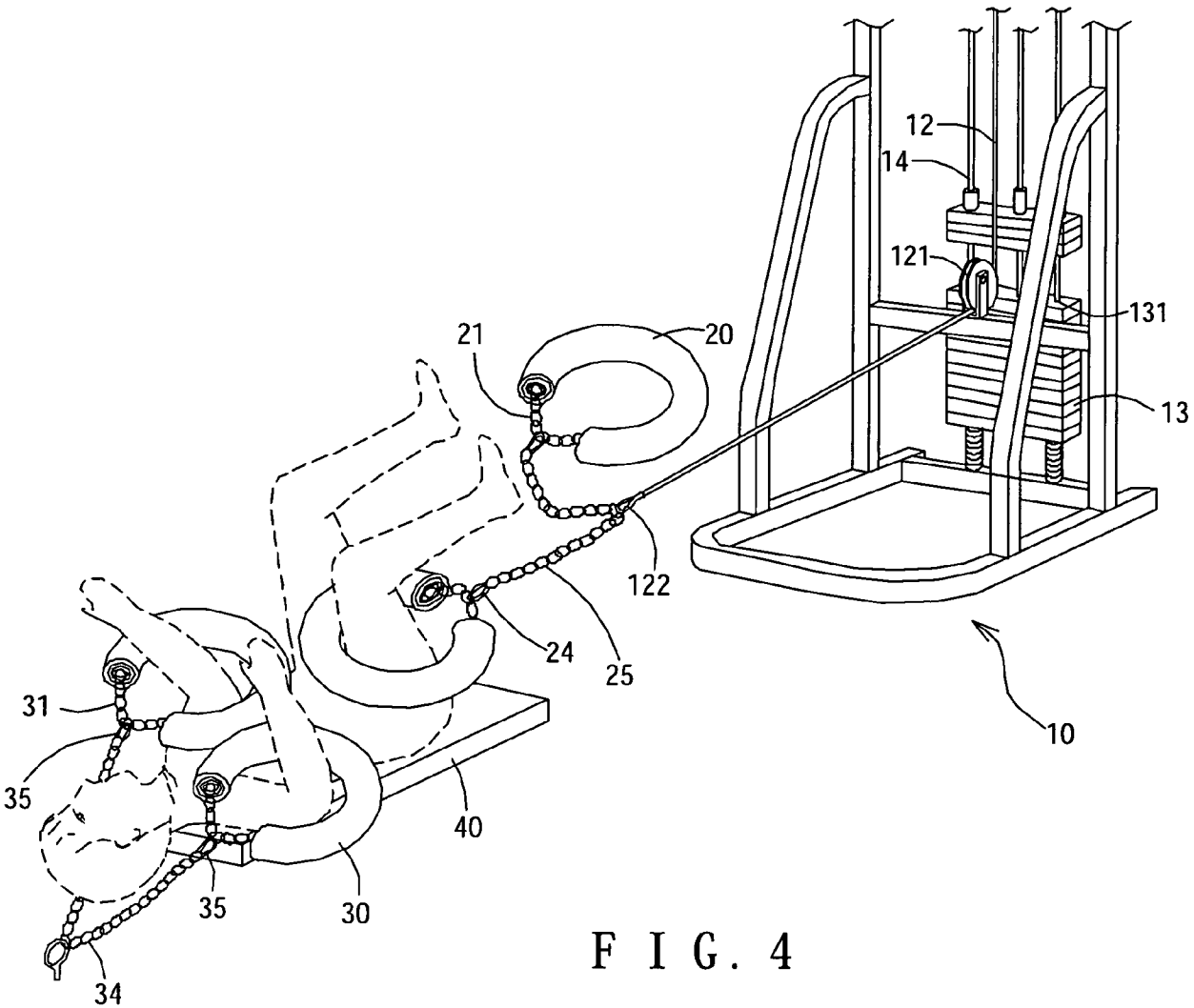

As shown in FIG. 4 specifically, in another operation a person lays his/her back on the pad 40 with only one leg (e.g., the right leg) passed the right first C-shaped tube 20 and two arms passed the second C-shaped tubes 30 to cross in front of the chest. Next, the leg bends toward the abdomen. The abdomen then exerts force to cause the right first C-shaped tube 20 to pull the steel rope 12 rearwardly, resulting in a lifting of a number of blocks of weight 13 along posts 14 and maintaining the same for a period of time. The to and fro operation thus illustrated aims at training both the abdominal muscles and one leg.

Figure 5:
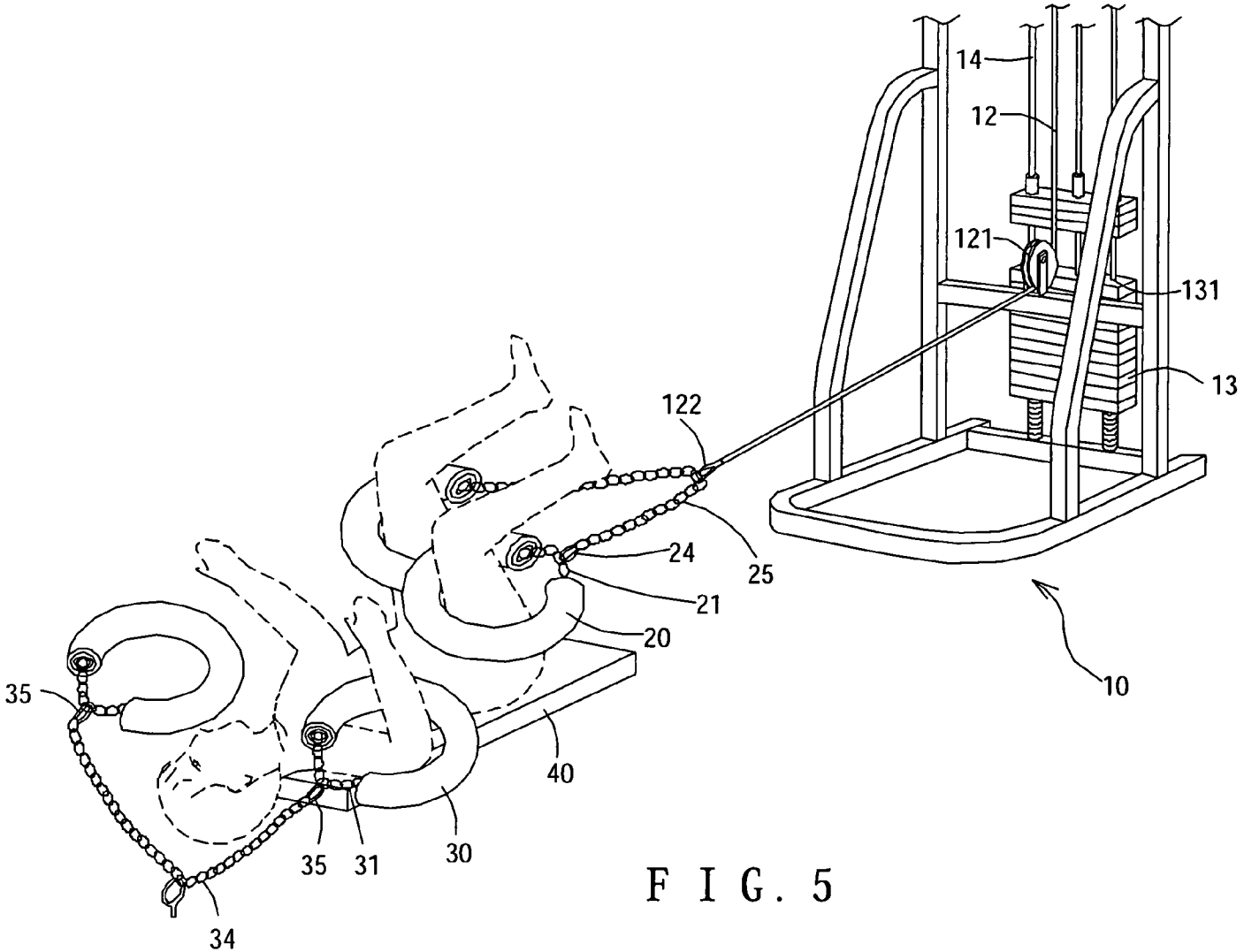

As shown in FIG. 5 specifically, in still another operation a person lays his/her back on the pad 40 with two bent legs passed the first C-shaped tubes 20 to contact the floor and only one arm (e.g., the right arm) passed the right second C-shaped tube 30 to cross with the other arm in front of the chest. Next, use the left arm to pull the steel rope 12 rearwardly, resulting in a lifting of a number of blocks of weight 13 along posts 14 and maintaining the same for a period of time. The to and to restore operation thus illustrated aims at training the biceps of one arm, the abdominal muscles and the legs.

Figure 6:
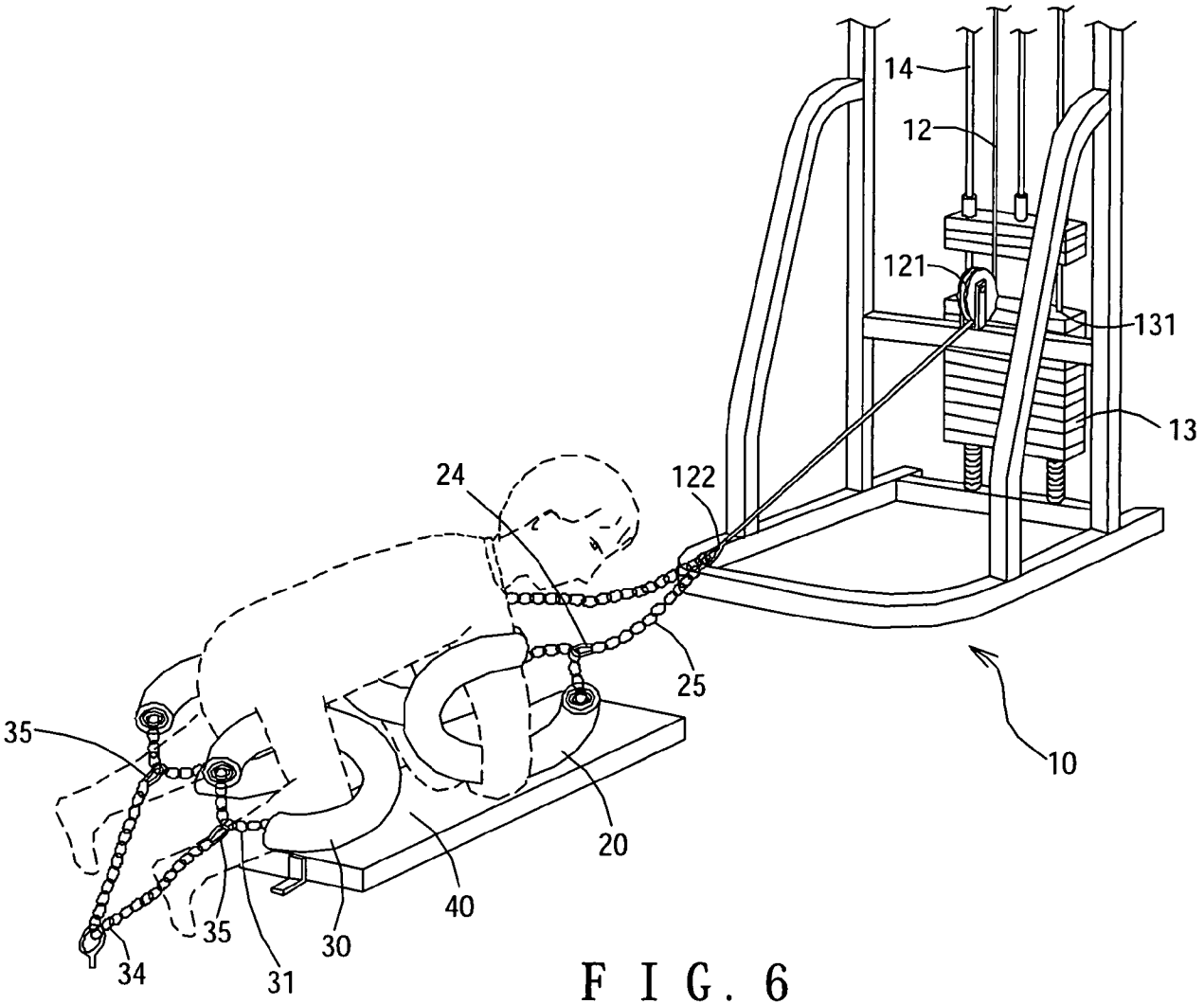

As shown in FIG. 6 specifically, in a further operation a person knees on the pad 40 with two arms passed the first C-shaped tubes 20 to cross in front of the chest and two legs passed the second C-shaped tubes 30. Next, move the arms toward the abdomen to pull the steel rope 12 rearwardly, resulting in a lifting of a number of blocks of weight 13 along posts 14 and maintaining the same for a period of time. The to and to restore operation thus illustrated aims at training the biceps of the arms, the abdominal muscles and the legs.

Figure 7:
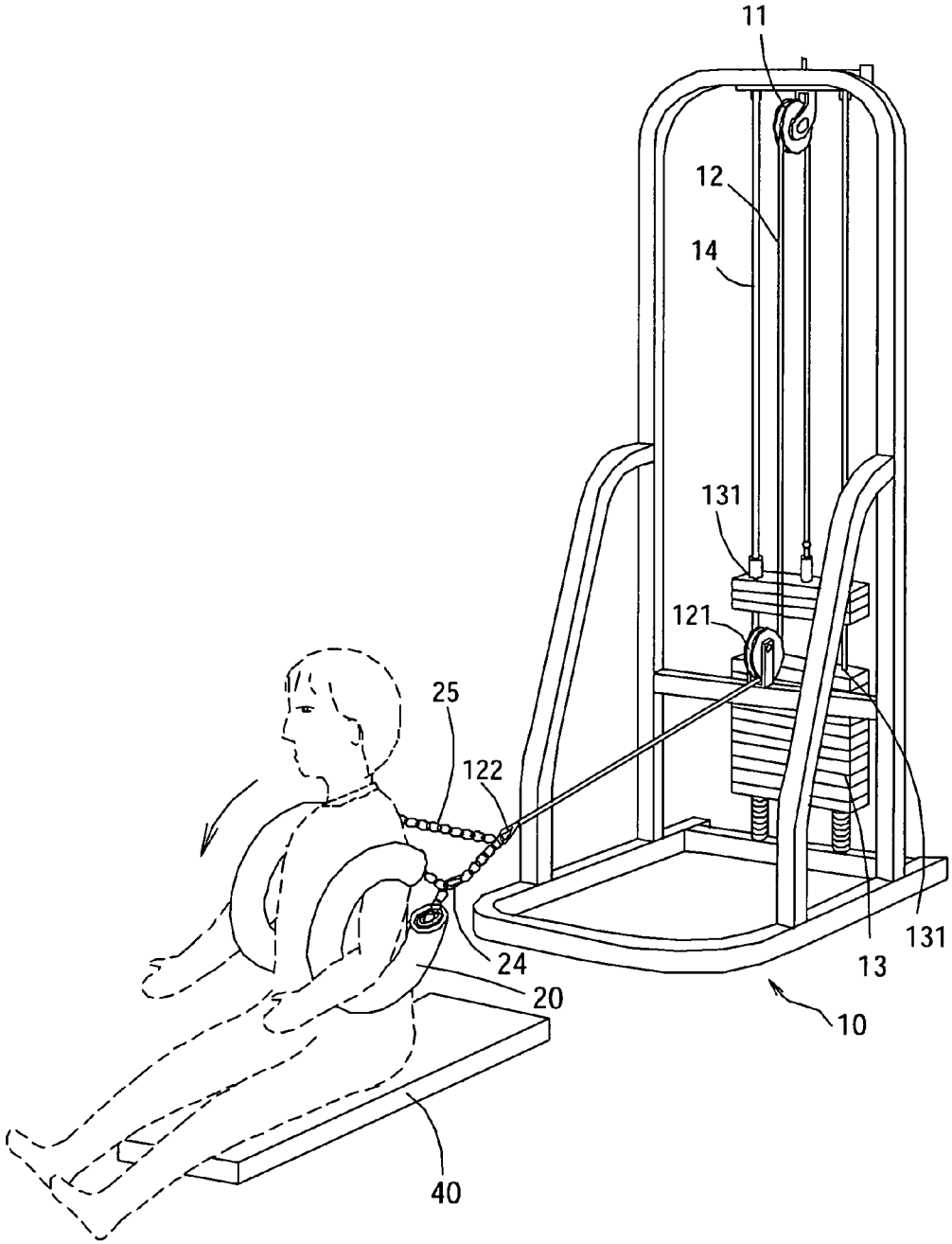

As shown in FIG. 7 specifically, in still further operation a person sits on the pad 40 with two arms passed the first C-shaped tubes 20. Next, bend the body forward by exerting force on the abdomen and the back to pull the steel rope 12 rearwardly, resulting in a lifting of the number of blocks of weight 13 along posts 14 and maintaining the same for a period of time. The to and to restore operation thus illustrated aims at training both the abdominal muscles and the back muscles.

In brief, the multipurpose exerciser of the invention is adapted to achieve two or more of purposes including contracting the abdominal muscles and training the arms, the legs, and the back muscles. Moreover, a user simply needs to buy a single, multipurpose exerciser rather than a plurality of different exercisers, resulting in a saving of money.

While the invention herein disclosed has been described by means of specific embodiments, numerous modifications and variations could be made thereto by those skilled in the art without departing from the scope and spirit of the invention set forth in the claims.

What is claimed is:

1. A multipurpose exerciser, comprising an upright frame, a top pulley on the frame, a steel rope adapted to run a grooved rim of said top pulley, a plurality of stacked blocks of weight fastened at one end of said steel rope, a lower pulley adjacent said blocks of weight with the other end of said steel rope passed said grooved rim thereof, a pair of left and right first C-shaped tubes coupled to the other end of said steel rope, a pair of left and right second C-shaped tubes, and a first chain having both ends coupled to said second C-shaped tubes respectively and a midpoint fastened at the floor, wherein two or more of said legs and said arms of a person are adapted to pass two or more of said first and said second C-shaped tubes for exercising.

2. The multipurpose exerciser according to claim 1, wherein each of said first and said second C-shaped tubes comprises a circular second chain, a plastic inner sleeve with said second chain passed, and at least one resilient outer sleeve fitted on said inner sleeve.

3. The multipurpose exerciser according to claim 1, further comprising a first ring formed at the other end of said steel rope, a third chain having a midpoint coupled to said first ring, and two second rings each coupled to both ends of said third chain.

4. The multipurpose exerciser according to claim 2, further comprising two third rings each coupled to said exposed portion of said second chain and either end of said first chain.

5. The multipurpose exerciser according to claim 1, further comprising a pad on the floor between said left and right first C-shaped tubes and between said left and right second C-shaped tubes.

6. The multipurpose exerciser according to claim 1, wherein each of said blocks of weight comprises left and right channel, said multipurpose exerciser further comprising two posts passed said left and right channels respectively to fasten between said top and said bottom of said frame.

* * * * *